United States Patent [19]

Hageman

[11] 4,444,446

[45] Apr. 24, 1984

[54] ELECTRICAL CONNECTOR FOR LUMINOUS DISPLAY HAVING ELECTRIC DISCHARGE TUBE

[76] Inventor: Neil Hageman, 39 Moraga Dr., Chico, Calif. 95926

[21] Appl. No.: 303,955

[22] Filed: Sep. 21, 1981

Related U.S. Application Data

[63] Continuation-in-part of Ser. No. 202,193, Oct. 30, 1980, abandoned.

[51] Int. Cl.[3] ..... H01R 33/08

[52] U.S. Cl. ..... 339/50 R; 40/545; 339/56

[58] Field of Search ..... 339/50 R, 50 S, 52 R, 339/52 S, 55–57, 50 C, 53, 54; 40/545; 362/217–224

[56] References Cited

U.S. PATENT DOCUMENTS

| | | | |
|---|---|---|---|
| 1,722,915 | 7/1929 | Hendry | 339/50 R |
| 1,951,431 | 3/1934 | Meehan | 339/50 R |
| 1,962,347 | 6/1934 | Ingold | 339/50 R |
| 2,104,217 | 1/1938 | Barnes | 174/152 G |
| 2,145,967 | 2/1939 | Boland et al. | 40/545 |
| 2,413,666 | 12/1946 | Tuck et al. | 362/220 |
| 2,420,826 | 5/1947 | Irrgang | 339/103 B |
| 2,472,977 | 6/1949 | Mageoch et al. | 339/55 |
| 2,505,163 | 4/1950 | Wanner | 339/93 R |
| 2,529,990 | 11/1950 | Barker | 362/220 |
| 2,651,024 | 9/1953 | Miller | 339/57 |
| 2,715,216 | 8/1955 | Howenstine | 339/56 |
| 3,094,364 | 6/1963 | Lingg | 339/64 M |
| 3,426,312 | 2/1969 | Fitzgerald | 339/56 |

FOREIGN PATENT DOCUMENTS

| | | | |
|---|---|---|---|
| 455078 | 2/1950 | Italy | 339/56 |
| 330036 | 6/1930 | United Kingdom | 40/545 |

OTHER PUBLICATIONS

Publication: P-K, Peterson Neon Electrode Receptacle and Accessories, p. 83, 7-1980.

*Primary Examiner*—Neil Abrams

*Attorney, Agent, or Firm*—Manfred M. Warren; Robert B. Chickering; Glen R. Grunewald

[57] ABSTRACT

An electrical connector is disclosed for luminous displays having a gaseous electric discharge tube within a tube housing. The structure includes a connector housing adapted for mounting within the tube housing and for receipt of a high-tension wire. A tubular dielectric member dimensioned for receipt of the electrode bearing end of an electric discharge tube is carried by the connector housing for longitudinal reciprocation through a wall thereof with proximal and distal ends of the member positioned respectively within and externally of the connector housing. The dielectric member is mounted for reciprocation between extended and retracted positions of its distal end with respect to the connector housing wall and such distal end is open for telescopically receiving the electrode bearing end of the electric discharge tube. A spring urges the dielectric member to its extended position and an electric contact is carried within the member for engagement with the electrode contact on the tube end. The proximal end of the member is open for receipt of a high-tension wire to the contact carried within the tubular dielectric member.

5 Claims, 3 Drawing Figures

ELECTRICAL CONNECTOR FOR LUMINOUS DISPLAY HAVING ELECTRIC DISCHARGE TUBE

RELATED APPLICATION

This application is a continuation-in-part of my application, Ser. No. 202,193, filed Oct. 30, 1980, and now abandoned for Electrical Connector for Gaseous Electric Discharge Tube.

BACKGROUND OF THE INVENTION

1. Field of Invention

The invention relates to electrical connectors used in the energizing of luminous advertising signs and displays e.g., neon signs, and more particularly to the manner of connection of the high tension electrical conductors to the electrodes conventionally mounted at the ends of the gas filled electric discharged tubes.

2. Description of Prior Art

Typically, the display tubes are mounted in a display or sign housing appropriately supported at the exterior of a building, and electrical connections are made through a length of rigid metal conduit which extends from the housing through the adjacent building wall to an electric raceway, box or the like, at the interior side of the wall. Electrodes are mounted in the opposite ends of lengths of gas-filled tubing and the electrodes have pig tail wires connected thereto and sealed in the adjacent end wall of the tube from which the wires extend for connection to the ends of the high tension conductors which are brought into the housing through the metal conduit. It has been common practice to effect the electrical connections by merely twisting together the pigtail wires and the ends of the high tension conductors.

Relatively high voltages are employed to excite the gas-filled tubes, and hence it is highly desirable to avoid the requirement for manual engagement of the connecting parts and the attendant electric shock hazard. A special connector known as the P-K connector has been developed to avoid this potential shock hazard. This connector comprises an enlarged dielectric tubular receptacle which is mounted within a cylindrical metal housing and which is adapted for mounting through the building wall on which the sign is mounted. The internal diameter of the dielectric receptacle is sufficiently large to telescopically receive an electrode bearing end of the neon tube which needs be fashioned to extend from the sign housing into the interior of the dielectric receptacle. An electric contact within the receptacle is connected to the end of a high tension conductor and makes contact with an electrode connected contact member carried at the end of the inserted tube. Consequently, the electrical connection to the tube is effected within the interior of the dielectric receptacle away from possible manual engagement and the connection is made automatically upon insertion of the tube end into the receptacle. The P-K connector has two principal disadvantages. One, the connector is of large size and requires the boring through the wall of relatively large holes for each of the high tension connectors. Secondly, the electrical connection is effected outside of the conventional sign housing and requires special fashioning of the electrode bearing ends of the sign tubes to provide for the extension of such ends through the normally back wall of the sign housing, outside of the housing, and into the wall mounted receptacles. Since only one electrical connection can be made for each P-K connector, a minimum of two such large wall openings and P-K connectors are required for each separately energized character or portion of the sign.

SUMMARY OF THE INVENTION

A principal feature of the present invention is that the connection of the electrode ends of the gaseous electric discharge tubes to the high-tension supply cables is totally enclosed within the interior of the conventional letter channel and within a dielectric enclosure fully protected against manual engagement of any of the high-tension parts. Thus the sign or display may be manufactured completely self-contained with all of the electrical connections made within the interior of the sign housing and with no portion of the neon tube required to project out of the sign housing. Only fully insulated dielectric parts are handled and manipulated during installation of the electrodebearing ends of the neon tube within the connector.

A further object and feature of the present invention is to provide an electrical connector of the character described in which a pair of high tension conductors may be carried in a single wall mounted conduit of relatively small diameter where double stroke or double tube characters are being energized, thus reducing to one-half the numbers of holes required to be drilled through the building wall on which the sign is mounted.

Still another object of the present invention is to provide a connector of the character described which is composed of a minimum number of sturdily designed parts which will provide a very long, useful and trouble-free life.

The invention possesses other objects and features of advantage, some of which of the foregoing will be set forth in the following description of the preferred form of the invention which is illustrated in the drawings accompanying and forming part of this specification. It is to be understood, however, that variations in the showing made by the said drawings and description may be adopted within the scope of the invention as set forth in the claims.

DETAILED DESCRIPTION OF THE INVENTION

Figure 1:
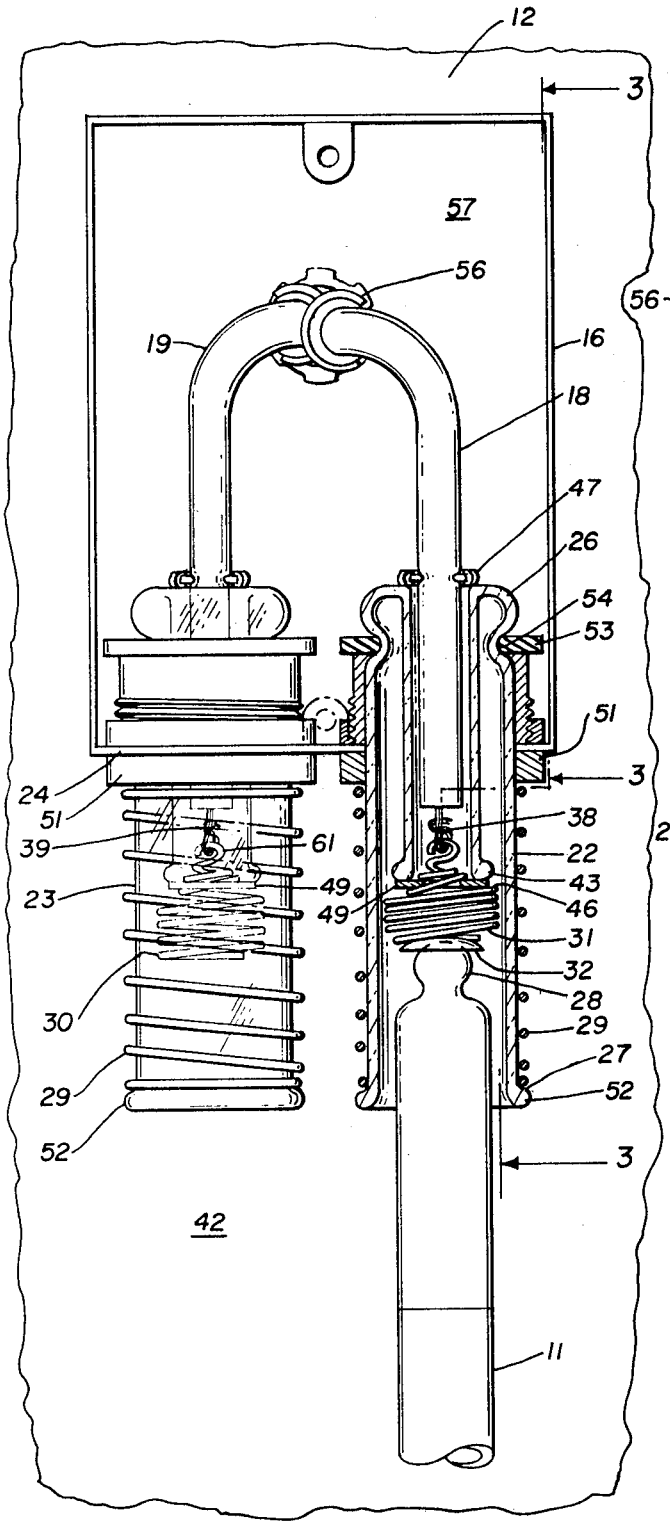
FIG. 1 is a front elevation of an electrical connector for the electric discharge tube of a luminous display with portions as shown in cross-section.

The electrical connector of the present invention is adapted for use with a luminous discharge having a gaseous electric discharge tube 11 within a conventional letter channel 12 mounted on the exterior side of a building wall 13. The connector comprises briefly a connector housing 16 mounted within the tube housing 12 and being adapted for connection to a conduit 17 extending through the building wall 13 for extension of one or more high-tension wires or cables 18 and 19 from an internal raceway 20 through conduit 17 and into the interior of connector housing 16; a tubular dielectric member, see members 22 and 23, carried by housing 16 for reciprocation through a wall 24 with proximal and distal ends 26 and 27 of the member positioned respectively within and externally of housing 16, the member 22, 23 being mounted for reciprocation between extended and retracted positions of distal end 27 with respect to wall 24, the distal end being open and the member being formed to telescopically receive an electrode-bearing end 28 of tube 11; spring means 29 urging member 22 to extended position; an electric contact 30, 31 within member 22, 23 and formed for engagement with an electrode contact 32 on tube end 28; and the proximal end 26 of member 22, 23 being open for receipt of high-tension cable 18, 19 for connection of their wire ends 38 and 39 to contacts 30 and 31.

Figure 3:
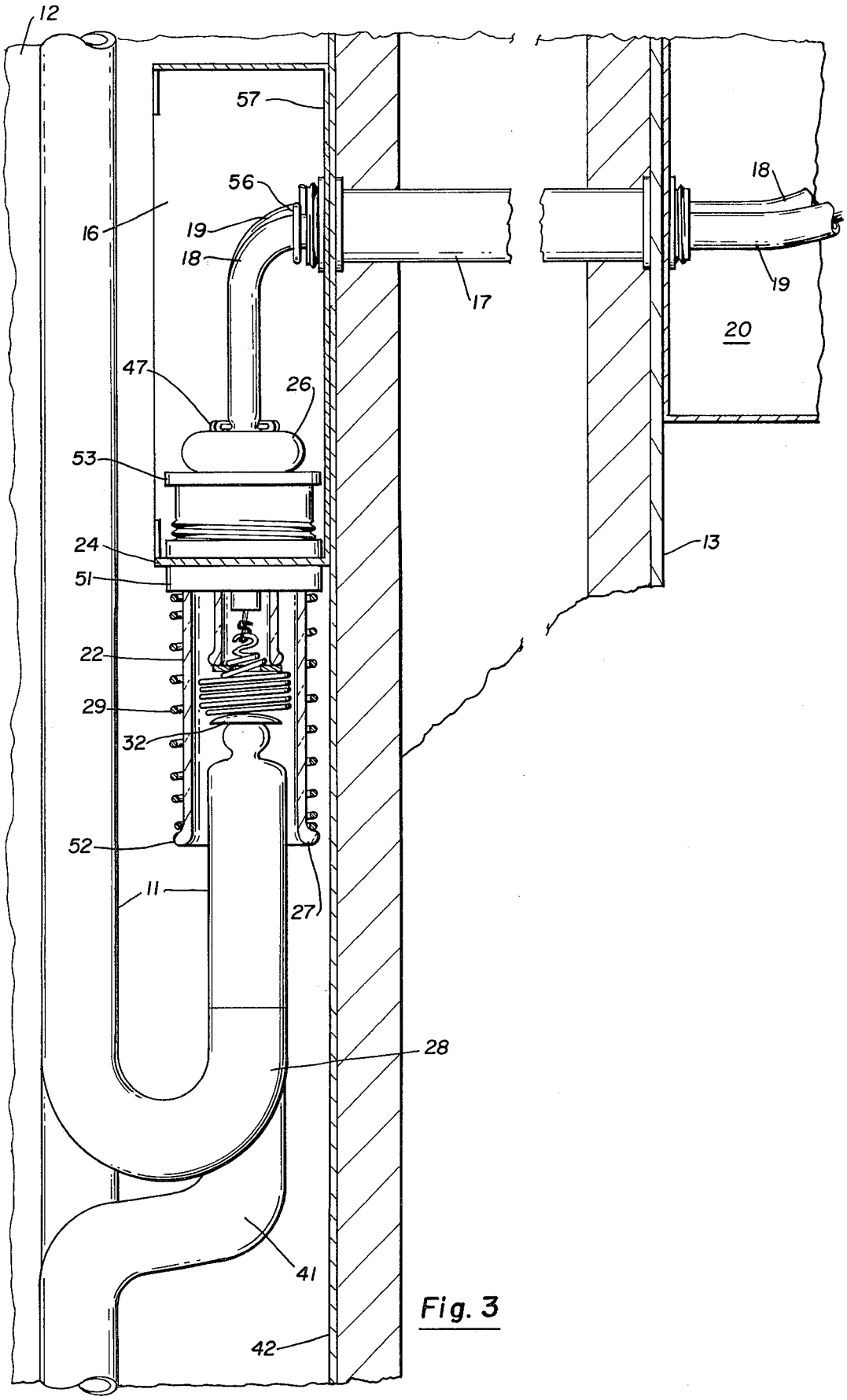
FIG. 3 is a cross-sectional view taken substantially of the plane of line 3—3 of FIG. 1.

The present connector may be used to connect either one or two tube ends. In the present configuration, a pair of tubular dielectric members 22 and 23 are mounted on housing 16 for connecting the adjacent ends 28 and 41 of a single tube or a pair of serially connected tubes. Typically, a letter or character may be outlined by two tubes, referred to in the trade as a double-tube letter. In such case, and as here shown, the two tube ends 28 and 41 are brought into spaced parallel side-by-side relation as seen in FIG. 3 for connection to a pair of connectors comprising members 22 and 23. In such case, a pair of high-tension cables 18 and 19 will be used and run through conduit 17. In other installations where only one tube end is available for energizing at one location, only a single connector may be used.

Connector box or housing 16 may be formed of sheet metal similar to other electric fixture and outlet boxes, and may be mounted at any convenient position on the rear wall 42 of the sign housing, typically an individual letter channel formed of about 4¼ inches wide, about 5 inches deep, and having a length sufficient to contain the length of an individual letter or other illuminated character or symbol. The connector box 16 will be mounted wherever it is convenient to juxtapose the opposite electrode-bearing ends of a neon tube, with the tube portions being bent in a manner similar to that illustrated in FIG. 3, so as to dispose the electrode-bearing ends in side-by-side relation as depicted.

Figure 2:
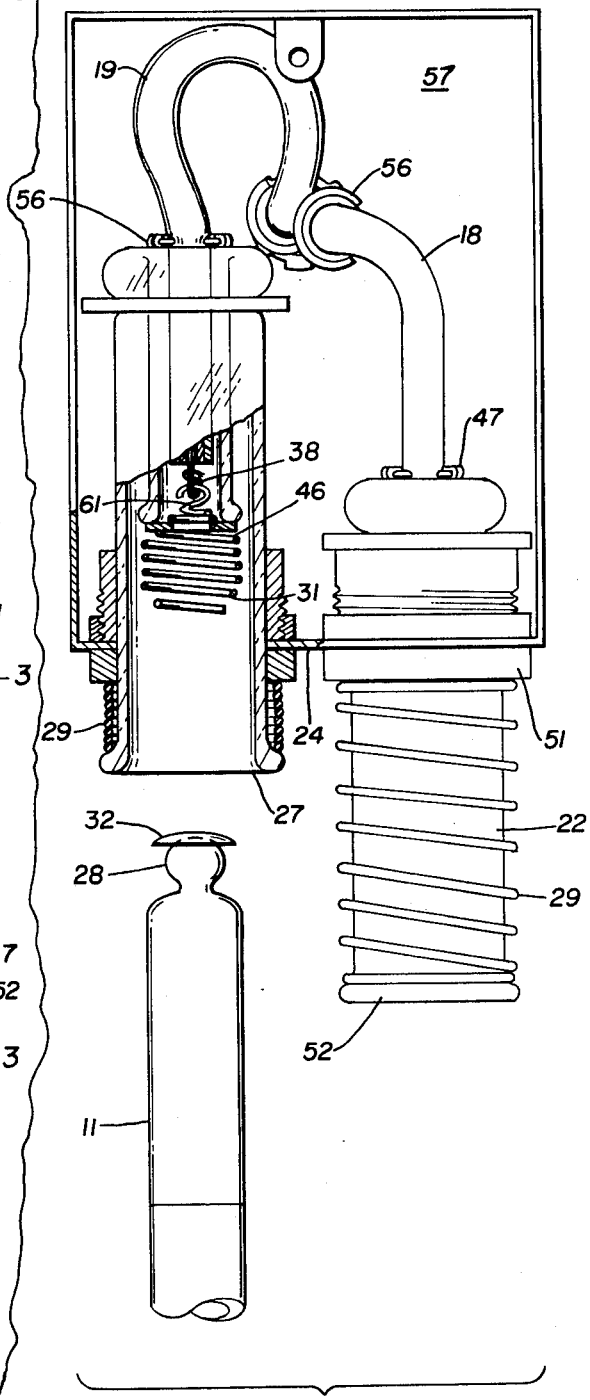
FIG. 2 is a view similar to FIG. 1 with the parts in different position.

As will be observed from the drawing electric contacts 30 and 31 here comprise helical springs formed of electrical conducting material, such as phosphorous bronze, and are mounted within the interior of members 22 and 23 for compression and expansion longitudinally of the members. Since the connectors are of identical construction, the description of one will hereafter suffice for both except as may be otherwise noted. Each of members 22 and 23 is formed with an internal shoulder 43 spaced from distal end 27, and spring 31 has one end 46 mounted on the shoulder and is adapted for connection to one of the high-tension wires 38, 39. Means 47, here in the form of a clip around the cable sheathing and bearing on proximal end 26, is used for securing the wire and member to provide conjoint reciprocal movement of the helical spring 31 and member 22, see FIG. 2, when member 22 is retracted against the urge of spring 29.

Preferably a washer 49, dimensioned to seat on shoulder 43 is formed with an opening to pass therethrough an end 61 of spring 31 for connection to the wire end 38, 39. As here shown, the spring end 61 is formed in a loop or eye mounted through the washer, and the high-tension wire is threaded through the eye and wrapped upon itself.

Mounting of member 22 for reciprocation through wall 24 is here effected by a bearing 51 having a pair of threaded parts mounted in wall 24 and dimensioned to slidably receive the outside circumferential surface of member 22 for its longitudinal reciprocation. Spring means 29 here comprises a helical spring surrounding member 22 and having opposite ends supported on bearing 51 and an out-turned rim 52 on the distal end 27. Preferably means, see washer 53, is provided at the proximal end 26 of the member for limiting its extended position under the influence of spring 29. As here shown, member 22 is formed with an annular recess 54 at its proximal end for receipt of an elastomeric washer 53 which is formed and dimensioned for distention into retained position in the recess and into blocking position against the adjacent end of bearing 51. Recess 54 thus provides a shoulder at the proximate end for supporting one side of the washer which in the extended position of the member is confined between this shoulder and the adjacent end face of bearing 51. A second clip 56 is preferably mounted on the wire sheathing in longitudinally spaced relation to clip 47 and adjacent the back wall 57 of box 16 for retaining a predetermined length of wire within the connector housing and to accommodate the aforementioned longitudinal reciprocation of the connector.

Where the connector is used within a channel for a double-stroke letter, as here illustrated, it is most common for the two electrode-bearing ends 28 and 41 of the tube to be positioned in parallel side-by-side relation. Accordingly, members 22 and 23 are similarly mounted in spaced parallel side-by-side relation and for reciprocation through a common wall 24 of the connector box. In other installations having a different confirmation of the electrode-bearing ends of the neon tube or tubes, the connectors may be otherwise disposed, e.g., other than side-by-side parallel relation and other than mounted on a common wall of the connector box.

To assemble the connector, the threaded parts of bearing 51 are assembled on wall 24 through an opening provided therefore in wall 24; helical spring 29 is slipped onto member 22 and the latter is inserted through bearing 51 to position its proximal end 26 interiorly of the bearing and to confine spring 29 between bearing 21 and rim 52 at the distal end of the member. Elastomeric washer 53 is then distended over the proximal end of the member and into a seated position in recess 54. The engagement of washer 53 against the interior side of bearing 51 limits the outward movement of member 22 under the urge of spring 29.

Conductor 18–19 is inserted through the open proximal end 26 of the tubular member 22–23 and its wire end 38–39 is connected to an end loop 61 of spring 31, the loop having been inserted through a medial opening in washer 49. Conductor 18–19 is then withdrawn from member 22 so as to seat washer 49 on shoulder 43 and is fixed in place by attachment of clip 47. Helical spring contact 30–31 is thus firmly supported within the interior of member 22 in spaced relation from distal end 52. Clip 56 is then mounted on conductor 18–19 adjacent the back wall 57 of the connector box so as to maintain a desired length of conductor within the box during longitudinal reciprocation of member 22–23.

To effect the electrical connection of the contacts 32 on the electrode bearing ends of the gaseous electric discharge tube 11, the ends to be connected will be fabricated so as to lie in side-by-side parallel position, the tube or tubes being supported within the letter channel or housing by conventional stand-off supports. Prior to their connection, the tube ends will be adjacent to and overlap the length of members 22 and 23. Members 22 and 23 will then be retracted against the resilience of spring 29 to the point where distal end 27 will clear the end of the tube to be connected, see FIG. 2. The tube end will then be moved into coaxial alignment with member 22, 23, and the latter released for movement to its extended position under the action of spring 29 so as to telescopically surround the tube end and advance the distal end of spring 30–31 into pressurized engagement with tube contact 32, placing spring 30–31 in compression. As will be observed, the manual retraction of member 22, 23 and the telescopic assembly of the tube end and automatic electrical connection thereof is effected without any possibility of manual contact with high-tension parts, and the electrical connection is effected within a protective dielectric enclosure.

What is claimed is:

1. An electrical connector for luminous displays having a gaseous electric discharge tube within a tube housing and doubled back on itself to present adjacent laterally spaced apart electrode bearing ends, comprising:

a connector housing adapted for mounting within said tube housing and being adapted for receipt of a pair of high-tension wires;

a pair of tubular dielectric members carried by said connector housing for longitudinal reciprocation through a wall thereof with proximal and distal ends of said members positioned respectively within and externally of said connector housing;

said members each being mounted for reciprocation between extended and retracted positions of its distal end with respect to said connector housing wall, each of said distal ends being open and formed to telescopically receive one of said electrode bearing ends of said tube;

spring means urging said members to extended positions;

an electric contact carried within each of said members and formed for engagement with an electrode contact on one of said tube ends, the proximal ends of said members being open for receipt of said high-tension wires in said connector housing for connection of said electric contacts; and said members being laterally spaced apart along said wall to be aligned with said spaced apart tube ends; the members each being retractable into said connector housing to an extent to permit movement of the tube end laterally through the space occupied by said member in extended position and into a stationary position of axial alignment with said member, said member then being extendable to move its distal open end towards and telescopically over said electrode contact of said stationary tube end and initiate engagement of said electric and electrode contacts outwardly of said connector housing.

2. The connector of claim 1 wherein said tube housing is mounted on the exterior side of a building wall; and said connector housing is adapted for connection to a conduit extending through said building wall and tube housing for securing said tube housing and said connector housing and for extension of said high-tension wires through said conduit and into said connector housing.

3. The connector of claim 2, said members each formed with an internal shoulder spaced from said distal ends;

said first-named contacts comprising helical springs having one end mounted on one of said shoulders for compression and expansion and being adapted for connection to one of said high-tension wires; and means adapted for securing said wires and members to provide conjoint reciprocal movement of said helical springs and members.

4. The connector of claim 3;

a pair of washers each dimensioned to seat one on each of said shoulders and each formed with an opening therein; and said helical springs each having an end formed for extension through one of said openings and for connection to one of said wires.

5. The connector of claim 1;

a pair of bearings mounted on said connector housing wall slidably receiving said members for longitudinal reciprocation;

said spring means comprising a pair of helical springs one each surrounding each of said members and having opposite ends supported on one of said bearings and the distal end of its associated member;

the proximate ends of said members being each formed with an annular recess; and an elastomeric washer formed and dimensioned for distention into retained position in each of said recesses and in position engageable with the adjacent end of said bearings for limiting the extended position of said members.

* * * * *